US011473429B2

(12) United States Patent
Akimoto

(10) Patent No.: US 11,473,429 B2
(45) Date of Patent: Oct. 18, 2022

(54) IMPELLER AND METHOD OF MANUFACTURING THE SAME

(71) Applicant: KABUSHIKI KAISHA TOYOTA JIDOSHOKKI, Aichi-ken (JP)

(72) Inventor: Kenta Akimoto, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/371,664

(22) Filed: Jul. 9, 2021

(65) Prior Publication Data

US 2022/0018258 A1 Jan. 20, 2022

(30) Foreign Application Priority Data

Jul. 14, 2020 (JP) ..... JP2020-120665

(51) Int. Cl.
*F01D 5/14* (2006.01)
*F01D 5/22* (2006.01)

(52) U.S. Cl.
CPC ..... *F01D 5/141* (2013.01); *F01D 5/225* (2013.01); *F05D 2220/30* (2013.01); *F05D 2230/10* (2013.01); *F05D 2240/24* (2013.01)

(58) Field of Classification Search
CPC ..... F01D 5/141; F01D 5/225; F04D 29/2216; F04D 29/225; F04D 29/2255;
(Continued)

(56) References Cited

U.S. PATENT DOCUMENTS 3,481,531 A * 12/1969 Macarthur ..... F04D 29/681 416/203
3,508,416 A * 4/1970 Miller ..... F25B 1/053 62/84

(Continued)

FOREIGN PATENT DOCUMENTS

JP 2019-116870 A 7/2019

OTHER PUBLICATIONS

Harvey Performance Company, "The Anatomy of an End Mill", Dec. 10, 2017, https://www.harveyperformance.com/in-the-loupe/end-mill-anatomy/ (Year: 2017).*

*Primary Examiner* — Courtney D Heinle
*Assistant Examiner* — Danielle M. Christensen
(74) *Attorney, Agent, or Firm* — Greenblum & Bernstein, P.L.C.

(57) ABSTRACT

An impeller including a hub surface and a plurality of blades protruding from the hub surface. Each of the plurality of blades has a pressure surface located on a leading side of the rotation direction and a suction surface located on a trailing side of the rotation direction. Each of the plurality of blades is provided with a plurality of first concave surfaces at a boundary between the pressure surface and the hub surface, and one second concave surface at a boundary between the suction surface and the hub surface. At least two different first concave surfaces having different concave radii in cross section are included in the plurality of first concave surfaces. A first concave radius that is the largest among the different concave radii is identical to a second concave radius that is a concave radius of the second concave surface in cross section.

6 Claims, 3 Drawing Sheets

(58) Field of Classification Search
CPC .... F04D 29/2272; F04D 29/24; F04D 29/242; F04D 29/284; F04D 29/30; F04D 29/42; F04D 29/4206; F05D 2220/30; F05D 2230/10; F05D 2240/24
See application file for complete search history.

(56) References Cited

U.S. PATENT DOCUMENTS

| | | | | |
|---|---|---|---|---|
| 5,215,439 | A * | 6/1993 | Jansen | F04D 29/284 415/914 |
| 9,951,787 | B2 * | 4/2018 | De Santis | F04D 29/284 |
| 2007/0134086 | A1 * | 6/2007 | Higashimori | F04D 29/284 415/208.3 |
| 2015/0354359 | A1 * | 12/2015 | Matsuda | F02B 39/00 416/204 A |

* cited by examiner

IMPELLER AND METHOD OF MANUFACTURING THE SAME

BACKGROUND ART

The present disclosure relates to an impeller and a method of manufacturing the same.

Japanese Patent Application Publication No. 2019-116870 discloses a method of manufacturing an impeller. In this method, a second blade is processed with a ball tapered end mill, which is gradually moved so as to change a position where it is point-milled from a proximal end toward a distal end of the second blade.

A cross-sectional shape of a corner of the proximal end of a blade may be changed depending on a shape of a blade edge of a cutter. The performance of the impeller can be improved by making a radius of the cross-sectional shape of the corner of the proximal end of the blade on a pressure surface located on a leading side of the blade in a rotation direction of the impeller smaller than the radius thereof on a suction surface located on a trailing side of the blade in the rotation direction of the impeller. In this case, the cutter corresponding to the cross-sectional shape of the corner on the pressure surface of the proximal end of the blade is used. Therefore, the number of cutting traces formed on the suction surface of the blade increases, and processing time of the suction surface of the blade increases.

The present disclosure has been made in view of the above problem, and an object of the present disclosure is to provide an impeller and a method of manufacturing the same that accomplishes a short processing time and improved performance.

SUMMARY

In accordance with an aspect of the present disclosure, there is provided an impeller including a hub surface formed around a rotary shaft, and a plurality of blades protruding from the hub surface, the plurality of blades being spaced apart from each other in a rotation direction of the rotary shaft. Each of the plurality of blades has a pressure surface located on a leading side of the rotation direction and a suction surface located on a trailing side of the rotation direction. Each of the plurality of blades is provided with a plurality of first concave surfaces, each of which is formed by cutting a trace, at a boundary between the pressure surface and the hub surface. Each of the plurality of blades is provided with one second concave surface, which is formed by a cutting trace, at a boundary between the suction surface and the hub surface. At least two different first concave surfaces having different concave radii in cross section are included in the plurality of first concave surfaces, and the different concave radii of the plurality of first concave surfaces include a first concave radius that is the largest among the different concave radii, and the first concave radius is identical to a second concave radius that is a concave radius of the second concave surface in cross section.

In accordance with another aspect of the present disclosure, there is provided a method of manufacturing an impeller including a hub surface formed around a rotary shaft and a plurality of blades protruding from the hub surface, the plurality of blades being spaced from each other in a rotation direction of the rotary shaft. The method includes forming a pressure surface located on a leading side of each of the plurality of blades in the rotation direction and a suction surface located on a trailing side of each of the plurality of blades in the rotation direction using a first end mill having a first blade edge radius in a first cutting step, and processing a boundary between the pressure surface and the hub surface using a second end mill having a second blade edge radius that is smaller than the first blade edge radius, after the first cutting step, in a second cutting step.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Figure 1:
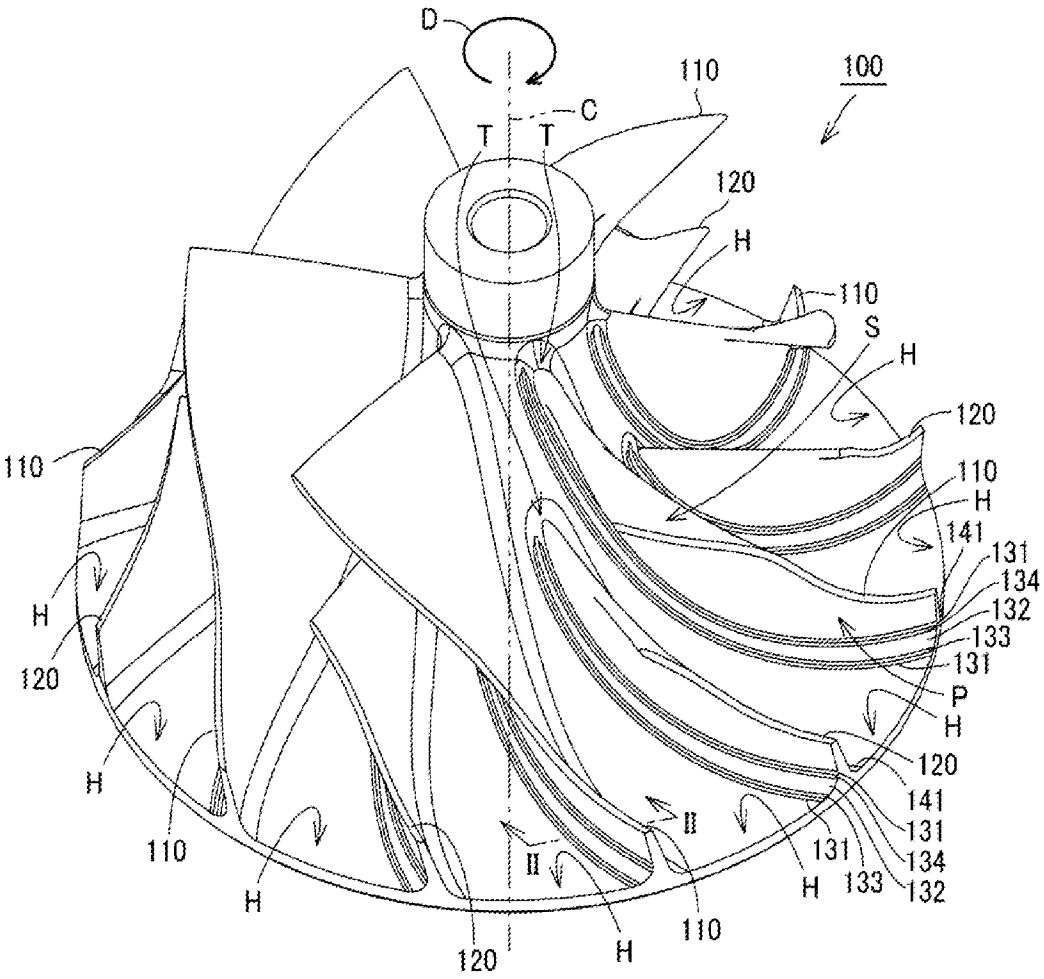
FIG. 1 is a perspective view of an impeller illustrating its configuration according to an embodiment of the present disclosure.

The following will describe an impeller and a method of manufacturing the same according to an embodiment of the present disclosure with reference to the accompanying drawings. In the following description, the same or corresponding parts in the drawings are denoted by the same reference numerals, and the description thereof will not be repeated.

Figure 2:
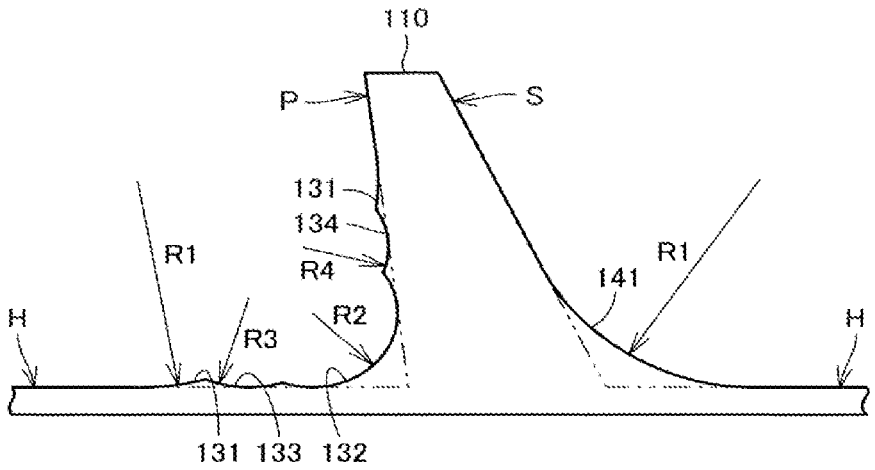
FIG. 2 is a cross-sectional view of a first blade of the impeller of FIG. 1, taken along line II-II as viewed in an arrow direction.

FIG. 1 is a perspective view of an impeller illustrating its configuration according to an embodiment of the present disclosure. FIG. 2 is a cross-sectional view of a first blade of the impeller of FIG. 1, taken along line II-II as viewed in an arrow direction.

As illustrated in FIGS. 1 and 2, an impeller 100 of the present embodiment includes a hub surface H and a plurality of blades. The hub surface H is formed around a rotary shaft C. The hub surface H extends generally in a shape of a lateral surface of a cone.

The impeller 100 includes a plurality of first blades 110 and a plurality of second blades 120. The first blades 110 and the second blades 120 are spaced apart from each other in a rotation direction D of the rotary shaft C, and protrude from the hub surface H. The first blades 110 and the second blades 120 are alternately disposed in the rotation direction D of the rotary shaft C.

The first blades 110 and the second blades 120 have different shapes. Each of the first blades 110 protrudes from the entire hub surface H with respect to the axial direction of the rotation axis C so as to extend inclinedly from a base end to an apex end of the lateral surface of the cone. The second blades 120 protrude in a lower portion of the hub surface H with respect to the axial direction of the rotary shaft C. For the sake of description, ends of each of the first blades 110 and the second blades disposed adjacent to the apex and the base end of the cone will be referred to as the tip end and the base end with respect to the axial direction of the rotary shaft C, respectively, in the following description.

Each of the plurality of first blades 110 has a pressure surface P located on a leading side of the rotation direction D and a suction surface S located on a trailing side of the rotation direction D. Each of the plurality of second blades 120 has a pressure surface P located on the leading side of the rotation direction D and a suction surface S located on the trailing side of the rotation direction D.

Each of the first and second blades 110, 120 has a plurality of first concave surfaces, each of which is formed by a cutting trace, at a boundary between the pressure surface P and the hub surface H. Each of the plurality of first concave surfaces extends along the boundary between the pressure surface P and the hub surface H.

The plurality of first concave surfaces includes at least two different first concave surfaces having different concave radii in cross section. The concave radius is a radius of an arc-shaped concave surface in cross section of the first blade 110.

In the present embodiment, the first concave surfaces having four different concave radii are formed, and reference numerals 131, 132, 133, 134 designate the first concave surfaces having a concave radius of R1, a concave radius of R2, a concave radius of R3, and a concave radius of R4, respectively. However, the number of variations of the concave radii of the first concave surfaces provided at the boundary between the pressure surface P and the hub surface H is not limited to four, as long as at least two different first concave surfaces having different radii are included. The number of variations of the first concave surfaces provided at the boundary between the pressure surface P and the hub surface H is preferably eight or less in view of processing time.

Of the concave radii of the first concave surfaces, the concave radius R1 of the first concave surface 131 is the largest and referred to as a first concave radius, and the concave radius R2 of the first concave surface 132 is the smallest. The concave radii R3 and R4 are smaller than the concave radius R1 and larger than the concave radius R2.

The first concave surface 132 is formed inside the first concave surface 131 at the center thereof. The first concave surface 133 is formed inside the first concave surface 131 on a side of the first concave surface 132 adjacent to the hub surface H. The first concave surface 134 is formed inside the first concave surface 131 on a side of the first concave surface 132 adjacent to the pressure surface P.

As viewed in cross section of the first blade 110, the first concave surface 131, the first concave surface 133, the first concave surface 132, the first concave surface 134, and the first concave surface 131 are disposed continuously in this order from the hub surface H toward the pressure surface P, such that each of the first concave surfaces are disposed side-by-side with another of the first concave surfaces in a direction from the hub surface toward the pressure surface.

A second concave surface 141, which is formed by a cutting trace, is formed at a boundary between the suction surface S and the hub surface H. The second concave surface 141 extends along the boundary between the suction surface S and the hub surface H. A concave radius of the second concave surface 141 is R1. That is, the second concave surface 141 and the first concave surface 131 have an identical concave radius. As described above, the first concave radius that is the largest among the concave radii of the plurality of first concave surfaces is R1 and is identical to a second concave radius of the second concave surface 141, which is a concave radius of the second concave surface 141 in cross section.

As illustrated in FIG. 1, the first concave surface 131 and the second concave surface 141 are formed continuously at the tip end T of each of the plurality of first blades 110 with respect to the axial direction of the rotary shaft C. The first concave surface 131 and the second concave surface 141 are formed continuously at the tip end T of each of the plurality of second blades 120 with respect to the axial direction of the rotary shaft C.

The following will describe a method of manufacturing an impeller according to an embodiment of the present disclosure.

Figure 3:
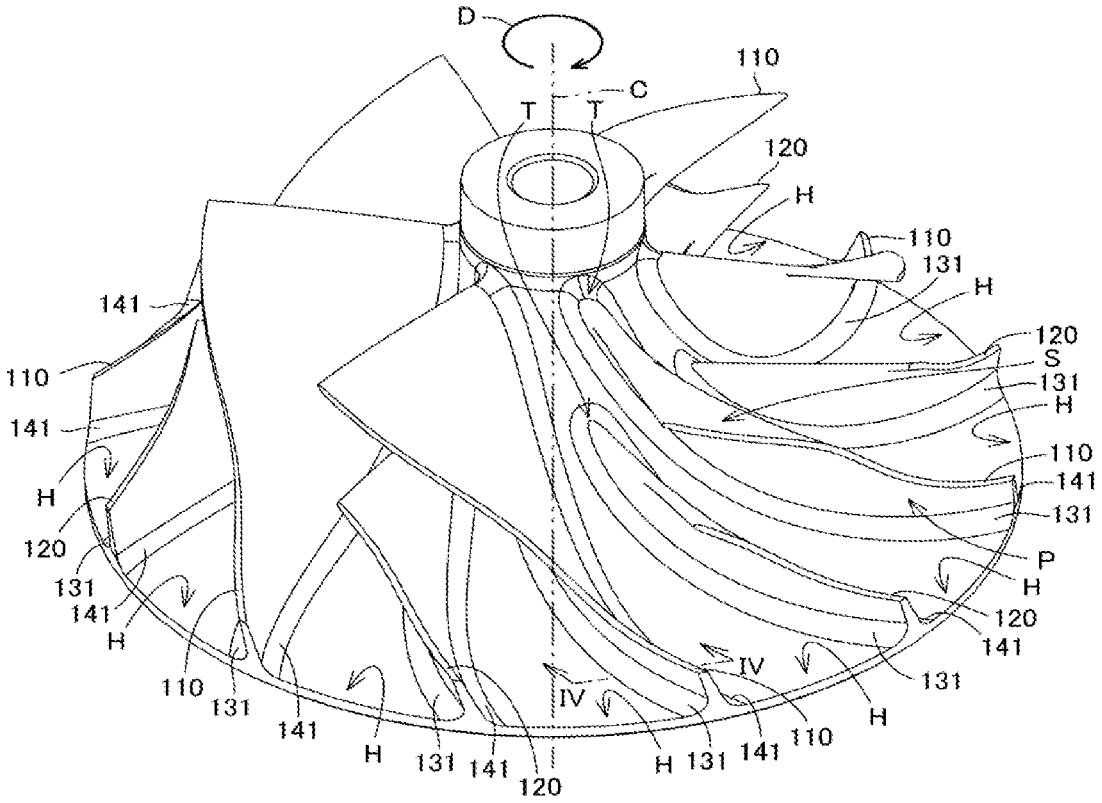
FIG. 3 is a perspective view of the impeller after a first cutting step according to a method of manufacturing an impeller of the present disclosure.
Figure 4:
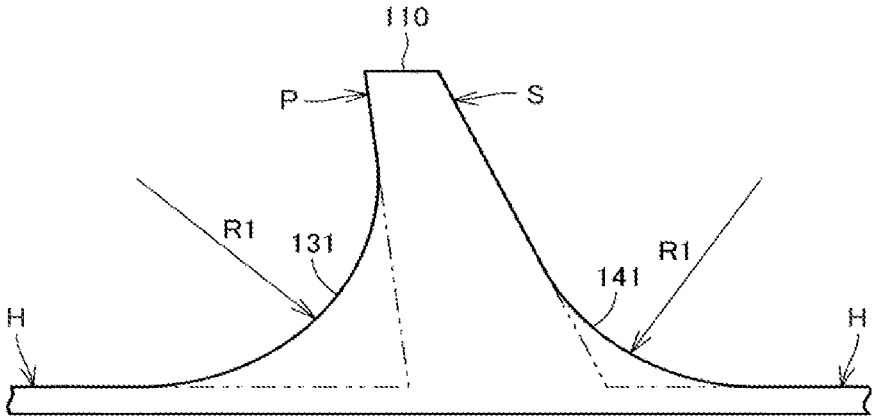
FIG. 4 is a cross-sectional view of the first blade of the impeller in FIG. 3, taken along line IV-IV as viewed in an arrow direction.

FIG. 3 is a perspective view of the impeller after a first cutting step according to a method of manufacturing an impeller of the present disclosure. FIG. 4 is a cross-sectional view of the first blade of the impeller in FIG. 3, taken along line IV-IV as viewed in an arrow direction.

In the first cutting step of the method of manufacturing an impeller according to an embodiment of the present disclosure, the pressure surface P located on the leading side of the rotation direction D and the suction surface S located on the trailing side of the rotation direction D of each of the first blades 110 and the second blades 120 are formed using a first end mill having a first blade edge radius. The first blade edge radius of the first end mill is R1.

As a result, as illustrated in FIGS. 3 and 4, the second concave surface 141 and the first concave surface 131 have an identical concave radius of R1. The first concave surface 131 and the second concave surface 141 are formed continuously at the distal end T of each of the first blades 110 and the second blades 120 with respect to the axial direction of the rotary shaft C, as illustrated in FIG. 3.

Figure 5:
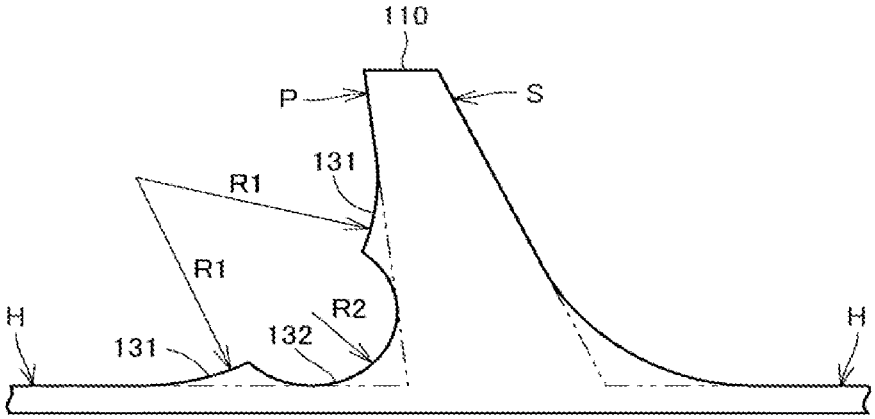
FIG. 5 is a cross-sectional view of the first blade of the impeller in which another first concave surface is formed at a boundary between a pressure surface and a hub surface in a second cutting step according to the method of manufacturing an impeller of the present disclosure.

FIG. 5 is a cross-sectional view of the first blade of the impeller in which another first concave surface is formed at a boundary between a pressure surface and a hub surface in a second cutting step according to the method of manufacturing an impeller of the present disclosure. FIG. 5 is illustrated in the same cross-sectional view as in FIG. 4.

After the first cutting step, the second cutting step is performed, so that the boundary between the pressure surface P and the hub surface H is processed using a second end mill having a second blade edge radius that is smaller than the first blade edge radius. The second blade edge radius of the second end mill is R2. As a result, as shown in FIG. 5, the first concave surface 132 having the concave radius of R2 is formed inside the first concave surface 131 at the center thereof.

Further, in the second cutting step, the boundary between the pressure surface P and the hub surface H is processed using the second end mill having the second blade edge radius of R3 and the second end mill having the second blade edge radius of R4. As a result, as shown in FIG. 1, inside the first concave surface 131, the first concave surface 133 is formed on the side of the first concave surface 132 adjacent to the hub surface H, and the first concave surface 134 is formed on the side of the first concave surface 132 adjacent to the pressure surface P2.

According to the impeller and the method of manufacturing the same of the present disclosure, after the pressure surface P and the suction surface S are processed using the first end mill having the first blade edge radius of R1, the boundary between the pressure surface P and the hub surface H is processed using the second end mill having the second blade edge radius smaller than the first blade edge radius. Thus, the processing time can be reduced. In the cross-sectional shape of the corner of the tip end of each of the first blade 110 and the second blade 120, the radius R2 on the pressure surface P located on the leading side in the rotation direction D of the impeller 100 is made smaller than the radius R1 on the suction surface S located on the trailing side in the rotation direction D of the impeller 100. Thus, the performance of the impeller 100 can be improved.

It should be understood that the embodiments disclosed herein are illustrative in all respects and not restrictive. The scope of the present disclosure is indicated not by the above description but by the claims, and it is intended to include meanings equivalent to the claims and all modifications within the scope.

What is claimed is:

1. An impeller comprising:

a hub surface formed around a rotary shaft; and a plurality of blades protruding from the hub surface, the plurality of blades being spaced apart from each other in a rotation direction of the rotary shaft, wherein each of the plurality of blades has a pressure surface located on a leading side of the rotation direction and a suction surface located on a trailing side of the rotation direction, each of the plurality of blades is provided with a plurality of first concave surfaces, each of which is formed by cutting a trace, at a boundary between the pressure surface and the hub surface, each of the plurality of blades is provided with one second concave surface, which is formed by a cutting trace, at a boundary between the suction surface and the hub surface, at least two different first concave surfaces having different concave radii in cross section are included in the plurality of first concave surfaces, wherein one of the at least two different first concave surfaces is inside another of the at least two different first concave surfaces, and the different concave radii of the plurality of first concave surfaces include a first concave radius that is the largest among the different concave radii, and the first concave radius is identical to a second concave radius that is a concave radius of the second concave surface in cross section.

2. The impeller according to claim 1, wherein the one of the at least two different first concave surfaces is formed inside the another of the at least two different first concave surfaces at a center of the another of the at least two different first concave surfaces.

3. An impeller comprising:

a hub surface formed around a rotary shaft; and a plurality of blades protruding from the hub surface, the plurality of blades being spaced apart from each other in a rotation direction of the rotary shaft, wherein each of the plurality of blades has a pressure surface located on a leading side of the rotation direction and a suction surface located on a trailing side of the rotation direction, each of the plurality of blades is provided with a plurality of first concave surfaces, each of which is formed by cutting a trace, at a boundary between the pressure surface and the hub surface, each of the plurality of blades is provided with one second concave surface, which is formed by a cutting trace, at a boundary between the suction surface and the hub surface, at least two different first concave surfaces having different concave radii in cross section are included in the plurality of first concave surfaces, and the different concave radii of the plurality of first concave surfaces include a first concave radius that is the largest among the different concave radii, and the first concave radius is identical to a second concave radius that is a concave radius of the second concave surface in cross section, wherein the first concave surfaces and the second concave surface are formed continuously at a tip end of each of the plurality of blades with respect to the axial direction of the rotary shaft.

4. The impeller according to claim 1, wherein each of the first concave surfaces are disposed side-by-side with another of the first concave surfaces in a direction from the hub surface toward the pressure surface.

5. A method of manufacturing an impeller including a hub surface formed around a rotary shaft and a plurality of blades protruding from the hub surface, the plurality of blades being spaced from each other in a rotation direction of the rotary shaft, the method comprising:

forming a first concave surface of a pressure surface located on a leading side of each of the plurality of blades in the rotation direction and a forming second concave surface of a suction surface located on a trailing side of each of the plurality of blades in the rotation direction using a first end mill having a first blade edge radius in a first cutting; and cutting at a boundary between the pressure surface and the hub surface another first concave surface inside the first concave surface using a second end mill having a second blade edge radius that is smaller than the first blade edge radius, after the first cutting, in a second cutting.

6. The method of manufacturing the impeller according to claim 5, wherein the second cutting comprises cutting a plurality of first concaves surface inside the first concave surface using at least two different second end mills having different second blade edge radii.

* * * * *